US008038380B2

(12) United States Patent
Opperud

(10) Patent No.: US 8,038,380 B2
(45) Date of Patent: Oct. 18, 2011

(54) POSITION INDICATION MECHANISM FOR A LOADER BUCKET

(75) Inventor: Arve Wilhelm Opperud, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 311 days.

(21) Appl. No.: 11/856,644

(22) Filed: Sep. 17, 2007

(65) Prior Publication Data

US 2009/0074551 A1 Mar. 19, 2009

(51) Int. Cl.
*A01B 39/00* (2006.01)

(52) U.S. Cl. ..... 414/722; 37/906; 172/430

(58) Field of Classification Search ..... 414/722, 414/685; 37/264, 906, 403, 466, 341; 16/DIG. 13, 16/284; 172/430
See application file for complete search history.

(56) References Cited

U.S. PATENT DOCUMENTS

| | | | | |
|---|---|---|---|---|
| 2,808,017 | A | 10/1957 | Kellebrew | |
| 2,986,294 | A | 5/1961 | Granryd | |
| 3,017,046 | A | 1/1962 | Runci et al. | |
| 3,141,563 | A | 7/1964 | Fisher | |
| 3,251,493 | A | 5/1966 | Popelier | |
| 3,710,968 | A | 1/1973 | Clevenger et al. | |
| RE29,603 | E * | 4/1978 | Oke et al. | 414/722 |
| 4,309,142 | A | 1/1982 | Shumaker | |
| 4,604,025 | A * | 8/1986 | Hammoud | 414/698 |
| 4,884,939 | A | 12/1989 | Nielsen | |
| 5,697,755 | A | 12/1997 | McCauley et al. | |
| 6,116,847 | A * | 9/2000 | Ginn et al. | 414/722 |
| 6,802,687 | B2 * | 10/2004 | Litchfield et al. | 414/699 |
| 2006/0182597 | A1 * | 8/2006 | Higashikawa et al. | 414/722 |

* cited by examiner

*Primary Examiner* — Donald Underwood
(74) *Attorney, Agent, or Firm* — Finnegan, Henderson, Farabow, Garrett & Dunner LLP

(57) ABSTRACT

A bucket position indication mechanism is provided for a material handling machine. The material handling machine includes a bucket and an operator's control station. The bucket position indication mechanism includes at least one position indicating element attached to the bucket at a position that is viewable by an operator at the operator's control station when a bottom plate of the bucket is aligned with a ground surface and at least a portion of the position indicating element extending in a direction parallel to the bottom plate of the bucket.

5 Claims, 3 Drawing Sheets

POSITION INDICATION MECHANISM FOR A LOADER BUCKET

TECHNICAL FIELD

The present disclosure relates to a bucket position indicating mechanism, and more particularly, to a position indicting mechanism for a bucket of a loading machine.

BACKGROUND

A loading machine, for example an industrial loader, typically has a loader bucket and linkages for providing the bucket with loading positions, transporting positions, and dumping positions, etc. An operator of the loading machine, typically located at a cabin that is on the top of the loading machine, may have difficulty in properly positioning the bucket when the bucket is at a "low level." Particularly, when the bucket is at a loading, stripping or cleaning up position, which requires the bottom surface of the bucket being aligned with a ground surface, the bottom of the bucket is invisible to the operator. As a result, the operator may improperly position the bucket, such as in an oblique position with respect to the ground surface. Correcting for a better angle of the bucket wastes time and reduces the overall efficiency of the loading machine. Therefore, a bucket design which improves the operator's feel for the position of the bottom surface of the bucket may be desired for improving the overall efficiency of the loading machine.

U.S. Pat. No. 4,604,025 (the '025 patent) issued to Hammoud describes a position indicator for a material handling element (e.g., a bucket) of a machine. The position indicator in the '025 patent includes a plate pivotally attached to the material handling element in line with an operator's line of sight from the cab towards the material handling element. The plate has first indicia on an edge facing the operator, second indicia on a top surface of the plate, and third indicia on a bottom surface of the plate. When the material handling element is disposed at the predetermined angle during operation of the machine, the operator will only view the first indicia. Thus, during operation, if the operator only sees the first indicia, he may know that the material handling element is at the predetermined angle. If, on the other hand, he sees either the second or third indicia, he knows that the bucket is inclined relative to the predetermined angle, and he may adjust the bucket until he only sees the first indicia.

Although the position indicator of the '025 patent may provide the operator a sense of the level position of the bucket, because the line of sight from eyes of an operator to the position indicator varies for different operators, depending on the height of the operator, the position indicator needs to be adjusted each time a different operator drives the loading machine. Even for the same operator, he may change sitting positions from time to time, and his line of sigh may change, and that may often result in misalignment of the bucket with the predetermined angle if the operator keeps relying on the position indicator he set in his initial sitting position.

The present disclosure is directed to solving one or more of the deficiencies discussed above.

SUMMARY OF THE DISCLOSURE

In one aspect, the present disclosure is directed to a bucket position indication mechanism for a material handling machine. The material handling machine may include a bucket and an operator's control station. The bucket position indication mechanism may include at least one position indicating element attached to the bucket at a position that is viewable by an operator at the operator's control station when a bottom plate of the bucket is aligned with a ground surface and at least a portion of the position indicating element extending in a direction parallel to the bottom plate of the bucket.

In another aspect, the present disclosure is directed to a material handling machine. The material handling machine includes an operator's control station, a bucket, a linkage, and a bucket position indication mechanism. The bucket has a bottom plate, a top plate, and two side plates. The linkage may extend from the front of the operator's control station and be connected to the bucket at a front end thereof. The linkage controls operations of the bucket. The bucket position indication mechanism includes at least one position indicating element attached to the bucket at a location that is viewable by an operator at the operator's control station when the bottom plate of the bucket is aligned with a ground surface and at least a portion of the position indicating element extending in a direction parallel to the bottom plate of the bucket.

In yet another aspect, a method of constructing a bucket positioning indication mechanism on a bucket of a material handling machine may be provided. The material handling machine may have an operator's control station. The method may include providing at least one position indicating element, and attaching the at least one position indicating element to the bucket at a location that is viewable by an operator at the operator's control station when a bottom plate of the bucket is aligned with a ground surface and at least a portion of the position indicating element extending in a direction parallel to the bottom plate of the bucket.

DETAILED DESCRIPTION

Figure 1:
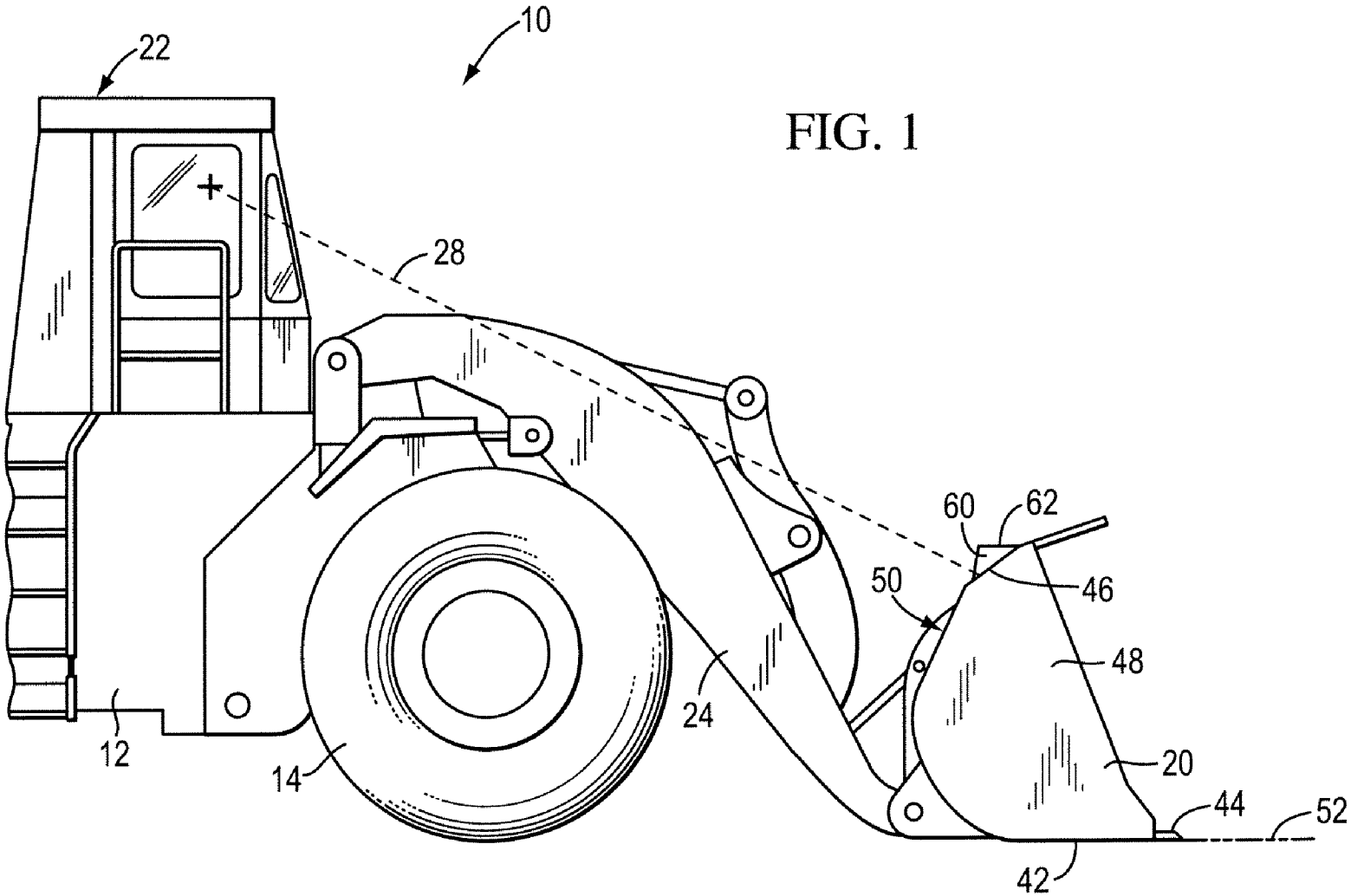
FIG. 1 is a side view of an exemplary loading machine incorporating an exemplary position indicating mechanism according to the present disclosure.

FIG. 1 illustrates a loading machine 10 that may employ the position indicator according to the present disclosure. The loading machine 10 may include a frame 12, a pair of front wheels 14 and a pair of rear wheels (not shown), and a material handling element, such as a bucket 20. The frame 12 may include an adjustable linkage 24 extending from the front of the frame 12. The bucket 20 may be pivotally attached to a front end of the adjustable linkage 24, which is adapted to control the bucket 20 to perform digging, loading, transporting, and dumping operations. The frame 12 may have an operator's control station (e.g., a cabin) 22 mounted thereon.

Figure 2:
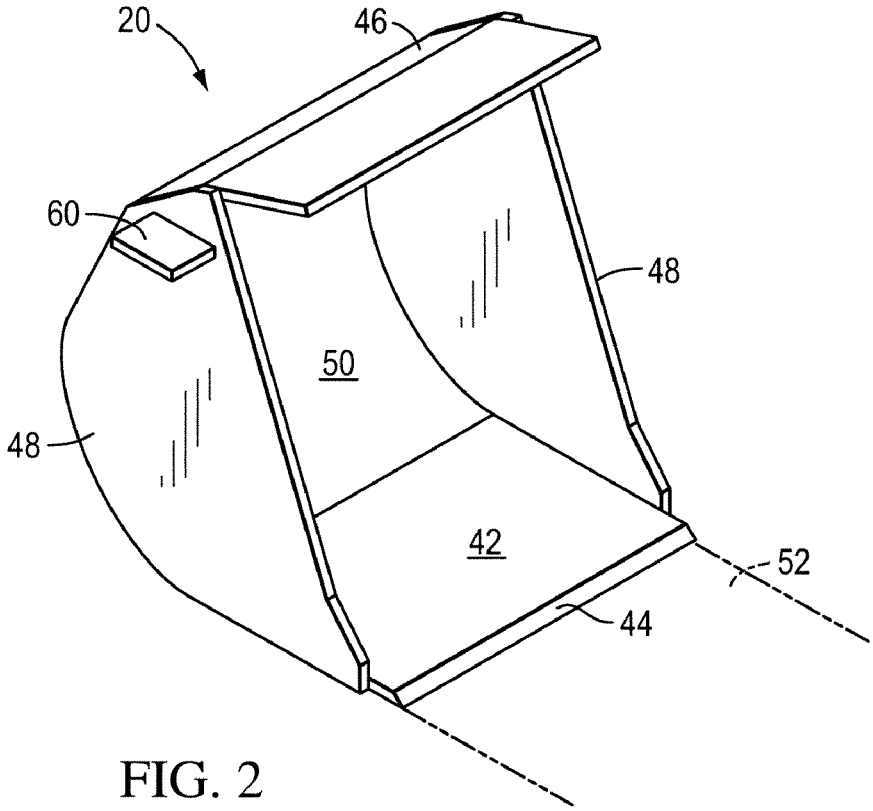
FIG. 2 is a schematic view of an exemplary position indicting mechanism according to one embodiment of the present disclosure.

As shown in FIGS. 1 and 2, the bucket 20 may include a bottom plate 42, a top plate 46, two side plates 48, and a back plate 50. A cutting edge 44 may extend from a front end of the bottom plate 42. The bottom plate 42, the top plate 46, the two side plates 48, and the back plate 50 form an open-face container (bucket) for loading and transporting materials. The bucket 20 may be adapted to dig, load, carry, and discharge materials.

In use, the materials, that need to be loaded and transported are often placed on the ground, and to effectively load such materials, the bucket 20 is preferably positioned with the bottom plate 44 aligned with or in parallel with the ground surface (as denoted by number 52). An operator of the loading machine 10 typically sits in the cabin 22, which is located at an upper left/right position relative to the bucket 20. In FIG. 1, line 28 indicates a line of view of an operator from the cabin 22. When the bucket 20 is aligned with the ground surface 52, the operator located in cabin 22 may only see the top plate 46 and an upper portion of the side plates 48 of the bucket 20. The operator's view to the bottom plate 42 may be obstructed by the top plate 46, the back plate 50, the side plates 48, and/or the linkage 24, which extends from the front of the frame 12 adjacent the cabin 22. Without viewing the bottom plate 42, the operator may have difficulty in properly aligning the bottom plate 42 with the ground surface 52.

Figure 3:
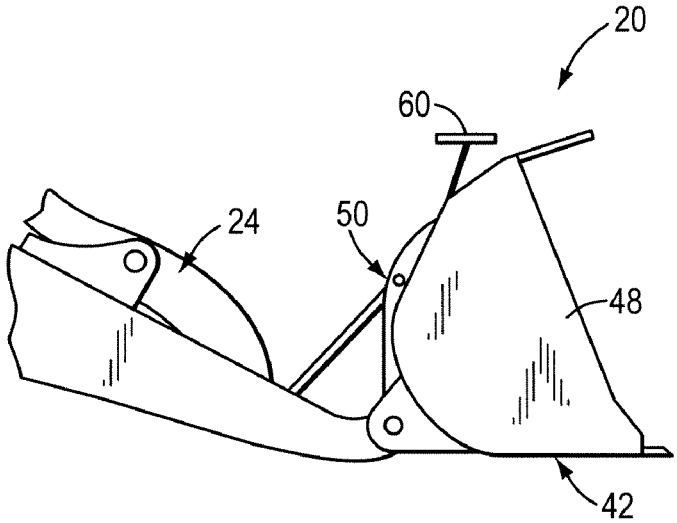
FIG. 3 is a schematic view of an exemplary position indicting mechanism according to another embodiment of the present disclosure.

One exemplary embodiment of a position indicator according to the present disclosure is shown in FIG. 2. As shown in FIG. 2, the position indicator may include at least one position indicating element 60, for example, a plate or board 60 that is attached to at least one of the side plates 48 of the bucket 20. The position indicating element 60 may be placed in a position that is viewable to the operator in the cabin 22, and in parallel with the bottom plate 42 of the bucket 20. In one example, the position indicating element 60 is attached to an upper portion of the side plate 48. Since the position indicating element 60 is parallel to the bottom plate 42, the operator can tell the angle of the bottom plate 42 by viewing the position indicating element 60, without viewing the bottom plate 42. For example, if the operator would like to align the bottom plate 42 with the ground surface 52, the operator may only need to view the position indicating element 60 and align the position indicating element 60 in parallel with the ground surface 52. In one embodiment, the position indicating element 60 is attached to the bucket 20 at a location such that the position indicating element 60 is viewable to the operator in the cabin 22 when the bucket 20 is placed on the ground surface 52. In another embodiment, the position indicating element 60 is attached to the bucket 20 at a location such that the position indicating element 60 is viewable to the operator in the cabin 22 when the bucket 20 is at any operable position. The position indicating element 60 may be positioned at either of the side plates 48. The position indicator may include two position indicating elements 60 respectively attached to the two side plates 48. A person skilled in the art should appreciate that the position indicating element 60 may be embodied in any shapes other than a plate or board. For example, the position indicating element 60 may be embodied in the shape of a rod or strip, so long as the position indicating element can be positioned in parallel with the bottom plate 42 and can be viewable by an operator in the cabin 22. The position indicating element 60 may also be positioned in other places, for example, on the back plate 50 or the top plate 46, as shown in FIG. 3.

Figure 4:
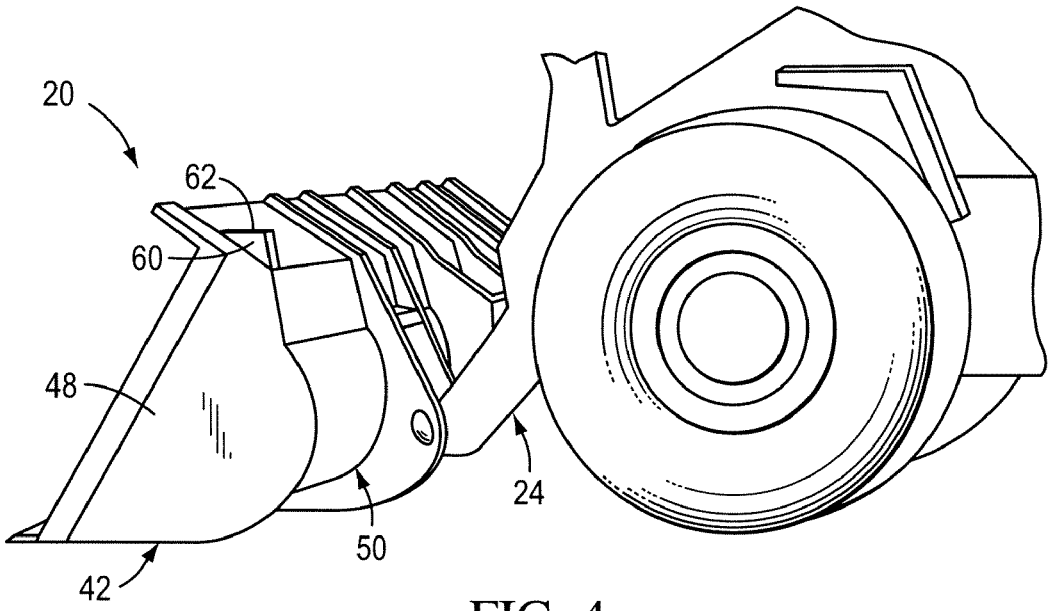
FIG. 4 is a schematic view of another exemplary position indicting mechanism according to another embodiment of the present disclosure.

Another exemplary embodiment of a position indicator according to the present disclosure is shown in FIG. 4. As shown in FIG. 4, the position indicator may include at least one position indicating element 60, for example, a plate 60. The position indicating element 60 may be attached to an upper edge of the side plate 48 or the top plate 46 extending in a direction parallel to the side plate 48 (including in the same plane as the side plate 48.) At least a portion of the position indicating element 60, for example, an upper edge 62, may be parallel to the bottom plate 42 and can be viewable by an operator in the cabin 22. By seeing the upper edge 62 of the position indicating element 60, the operator can tell the alignment of the bottom plate 42.

INDUSTRIAL APPLICABILITY

The disclosed position indicator may be applicable to any material handling machines, such as front loaders, bulldozers, etc. The disclosed position indicator may provide a relatively accurate and also easily assembled position indicting mechanism to indicate whether a bucket is positioned at a predetermined angle, and thus enhance the efficiency of the material handling machine when operations such as loading from a ground surface, stripping, or clean-up require the bucket to be positioned at a predetermined angle.

Figure 5:
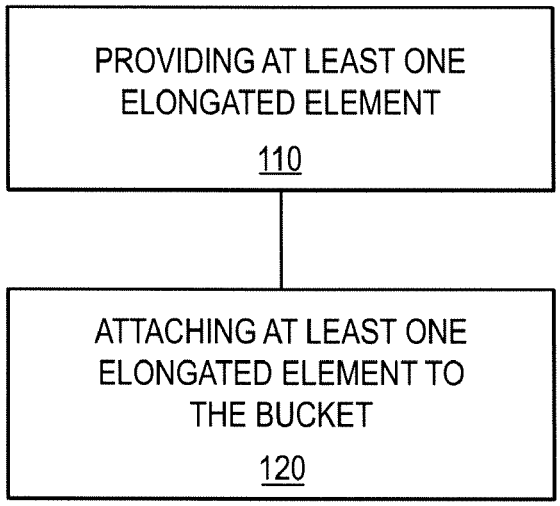
FIG. 5 shows a flow diagram of a method for providing a position indicting mechanism for a loading machine.

FIG. 5 shows a flow diagram of a method for assembling a position indicator. At step 110, at least one position indicating element may be provided. At step 112, the at least one position indicating element may be attached to the bucket, for example, to at least one of the side plates. At least a portion of the position indicating element may be positioned in parallel to the bottom plate of the bucket and may be viewable from an operator's control station when the bottom plate of the bucket is aligned with a ground surface or at any operable position.

In operation, when an operator in the control station desires to align the bottom plate of the bucket at a predetermined angle, for example, aligning the bottom plate with the ground surface, the operator need only place the bucket on the ground surface and align the portion of the position indicating element in parallel with the ground surface.

The position indicator of the present disclosure can be easily and inexpensively manufactured, since it involves simple components, and it can be easily assembled. One or more additional position indicators also can be selectively added and attached to the bucket if the operator desires. Furthermore, because the position indicator is positioned directly on the bucket, the position indicator of the present disclosure is accurately indicates the alignment of the bottom plate of the bucket.

It will be apparent to those having ordinary skill in the art that various modifications and variations can be made to the disclosed position indicating mechanism without departing from the scope of the disclosure. Other embodiments of the disclosure will be apparent to those having ordinary skill in the art from consideration of the specification and practice of the embodiments disclosed herein. It is intended that the specification and examples be considered as exemplary only, with a true scope of the disclosure being indicated by the following claims.

What is claimed is:

1. A method of constructing a positioning indication mechanism on a bucket of a material handling machine, comprising:

providing at least one position indicating element, the at least one position indicating element including a plate having a top surface that extends substantially perpendicular to a side face of the bucket, the plate being attached to a rod and the rod being attached to the bucket; and positioning the at least one position indicating element on the bucket such that, when a bottom face of the bucket is oriented parallel to the ground, the top surface of the plate is oriented parallel to the ground and is in a line of sight of an operator operating the material handling machine in an operator's control station of the material handling machine.

2. The method of claim 1, wherein the positioning includes positioning the at least one position indicating element on a top face, of the bucket.

3. The method of claim 1, wherein positioning the at least one position indicating element includes positioning the at least one position indicating element such that the top surface of the plate is in the line of sight of the operator when the bucket is placed at any operable position.

4. A position indication mechanism for a bucket of a material handling machine, comprising:

an operator control station;

a bucket; and at least one position indicating element attached to the bucket, the at least one position indicating element including a plate attached to the bucket with a rod, the plate having a top surface that extends substantially perpendicular to a side face of the bucket, wherein the top surface of the plate is oriented parallel to the ground and is in a line of sight of an operator in the operator control station when a bottom face of the bucket is oriented parallel to the ground.

5. The position indication mechanism of claim 4, wherein the at least one position indicating element is attached to a top face of the bucket.

* * * * *